US007228648B2

(12) United States Patent
Yang

(10) Patent No.: US 7,228,648 B2
(45) Date of Patent: Jun. 12, 2007

(54) HEEL CUSHION STRUCTURE FOR A SNEAKER

(76) Inventor: Teng-Jen Yang, No. 13, Alley 2, Lane 67, Jifeng Rd., Wufeng Hsiang, Taichung County (TW)

( * ) Notice: Subject to any disclaimer, the term of this patent is extended or adjusted under 35 U.S.C. 154(b) by 470 days.

(21) Appl. No.: 10/958,605

(22) Filed: Oct. 5, 2004

(65) Prior Publication Data

US 2006/0042122 A1 Mar. 2, 2006

(30) Foreign Application Priority Data

Aug. 24, 2004 (TW) ..... 93125414 A

(51) Int. Cl.
*A43B 13/28* (2006.01)

(52) U.S. Cl. ..... 36/35 R; 36/28; 36/27; 36/29; 36/37

(58) Field of Classification Search ..... 36/28, 36/29, 35 R, 37, 38, 27, 114
See application file for complete search history.

(56) References Cited

U.S. PATENT DOCUMENTS 1,403,970 A * 1/1922 Lioy ..... 36/3 B
2,454,951 A * 11/1948 Smith ..... 36/38
4,715,130 A * 12/1987 Scatena ..... 36/27
5,511,324 A * 4/1996 Smith ..... 36/27
5,651,196 A * 7/1997 Hsieh ..... 36/27
5,752,329 A * 5/1998 Horibata ..... 36/27
6,393,731 B1 * 5/2002 Moua et al. ..... 36/27
6,880,267 B2 * 4/2005 Smaldone et al. ..... 36/28
7,055,264 B2 * 6/2006 Gallegos ..... 36/3 B
7,082,698 B2 * 8/2006 Smaldone et al. ..... 36/28
2002/0083616 A1 * 7/2002 Hajianpour ..... 36/7.8
2003/0110661 A1 * 6/2003 Wu ..... 36/27
2003/0126760 A1 * 7/2003 LeVert et al. ..... 36/27
2004/0016144 A1 * 1/2004 Gallegos ..... 36/3 R
2004/0128860 A1 * 7/2004 Smaldone et al. ..... 36/28
2004/0181969 A1 * 9/2004 Smaldone et al. ..... 36/28
2005/0241184 A1 * 11/2005 LeVert et al. ..... 36/27
2006/0213082 A1 * 9/2006 Meschan ..... 36/27

* cited by examiner

*Primary Examiner*—Marie Patterson
(74) *Attorney, Agent, or Firm*—Charles E. Baxley

(57) ABSTRACT

The present invention relates to a heel cushion structure for a sneaker capable of adjusting the characteristic of the sneaker flexibly. The main body of the heel cushion structure is provided with plural separable elastic elements, so that the wearer is able to selectively screw different functional separable elastic elements according to personal needs. Thus, the wearer can selectively use the elastic elements according to personal needs. The cushion effect of the heel cushion structure of the sneaker can be adjusted by changing the separable elastic elements. Thereby, the present invention is truly a heel cushion structure that can flexibly adjust the characteristics of the sneaker.

12 Claims, 4 Drawing Sheets

HEEL CUSHION STRUCTURE FOR A SNEAKER

BACKGROUND OF THE INVENTION

1. Field of the Invention

The present invention relates to a heel cushion structure for a sneaker which is stalled at the lower edge of the rear of the sneaker, and more particularly to a heel cushion structure which is capable of flexibly adjusting the cushion effect of the sneaker.

2. Description of the Prior Arts

A sneaker is normally provided at its heel portion with an elastic element which is capable of supporting the wearer's weight and cushion the pressure. Vary kinds of elastic units used on the sneaker have become the sneaker producer's selling point. Hence, how to make a better elastic element that can satisfy the wearer's needs has become the most important thing in the sneaker manufacturing trade.

Most of the sneakers on the market are installed in its heel portion with an integral heel cushion structure which is made by elastic ejection, so that the heel block is able to support the weight and to produce a cushion effect. The preferable design is to make an air chamber (so-called air sneaker) inside the heel block. However, this conventional design still has some problems which are explained as follows:

First, the function, the characteristic and the elastic force of the conventional heel cushion cannot be changed once the sneaker is produced. However, different wearers with the same foot size may have different weights. In this case, the sneaker cannot satisfy different wearers' needs who have the same foot size (for example: heavy weight wearer should wear the sneaker with relatively hard heel cushion, and the light weight wearer preferably wear the sneaker with relatively soft heel cushion).

Second, after a certain time of use, the heel cushion of the sneaker will lose elasticity and supporting force gradually (the heel cushion with air chamber will also lose supporting force after the ambient structure is fatigued), especially, the heel cushion with air chamber is likely to be punctured by a sharp object and lose the cushion effect. For this reason, the wearer has to desert the sneaker, so that the problems are arisen, for example, the service life of this conventional sneaker is shortened, the wearer's money is wasted, and even causing an environmental protection problem. If the structure of the heel cushion is enforced (by strengthening the ambient structure), then the elasticity of the heel cushion (or the heel air cushion) will be weakened.

Third, a professional athlete has to wear different sneakers with different function and elasticity according to different situations, such as the ground, the landform and even the weather. Therefore, many different sneakers must be prepared, and this is inconvenient to carry.

The present invention has arisen to mitigate and/or obviate the afore-described disadvantages.

SUMMARY OF THE INVENTION

The primary object of the present invention is to provide a heel cushion structure for a sneaker capable of adjusting the characteristic of the sneaker flexibly. The main body of the heel cushion structure is provided with plural separable elastic elements, so that the wearer is able to selectively screw different separable elastic elements with different functions according to personal needs. Thus, the wearer can selectively use the elastic elements according to his/her love, weight and professional requirement. The cushion effect of the heel cushion structure of the sneaker can be adjusted by changing the separable elastic elements. Thereby, the present invention is truly a heel cushion structure that can flexibly adjust the cushion effect of the sneaker.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
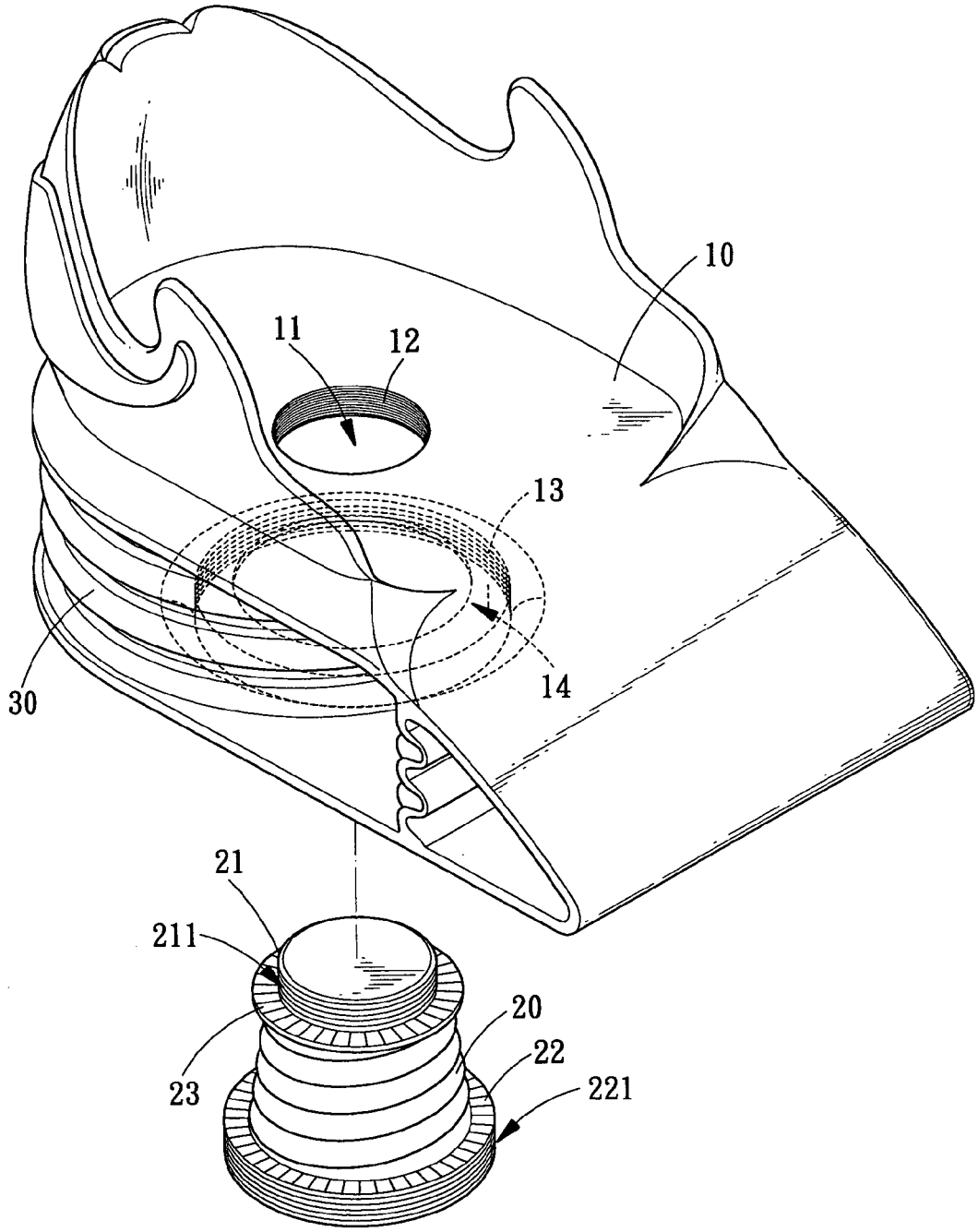
FIG. 1 is an exploded view of a heel cushion structure for a sneaker in according with a preferred embodiment of the present invention.
Figure 2:
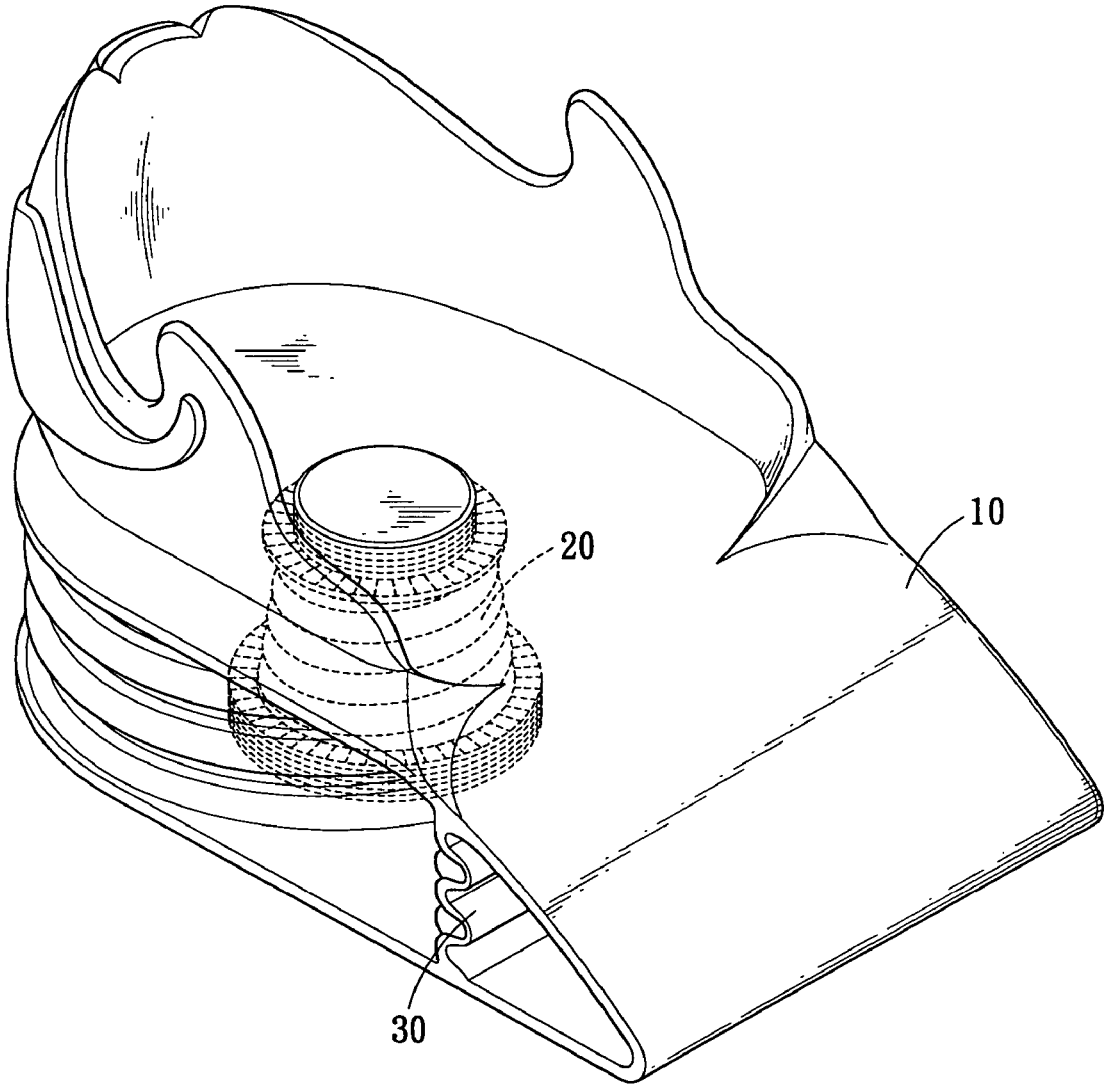
FIG. 2 is a perspective view of the heel cushion structure for a sneaker in according with the preferred embodiment of the present invention.
Figure 3:
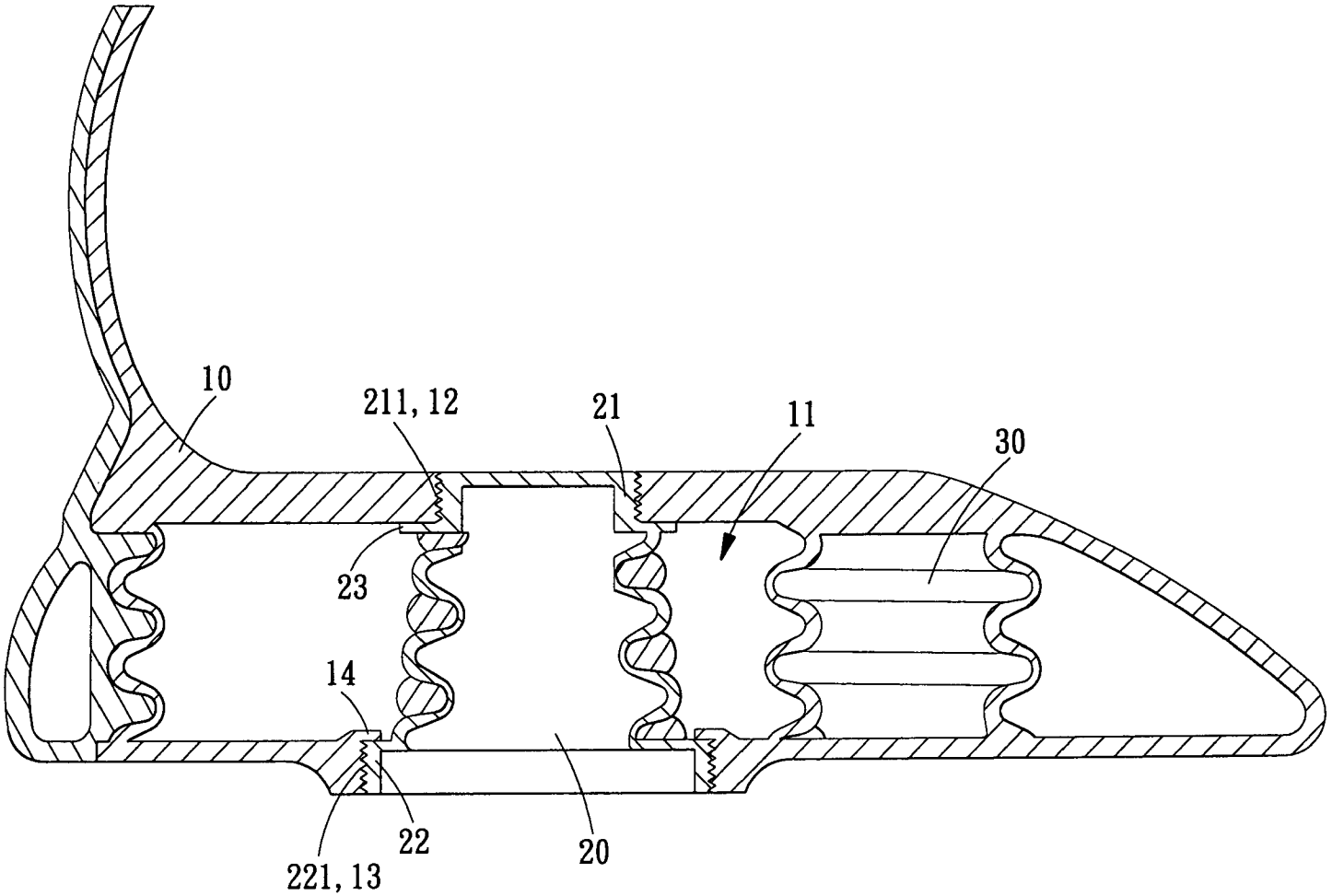
FIG. 3 is an assembly cross sectional view of a heel cushion structure for a sneaker in according with a preferred embodiment of the present invention.

Referring to FIGS. 1–3, a heel cushion structure for a sneaker in accordance with a preferred embodiment of the present invention is to be fixed at the lower edge of the rear of a sneaker (the sneaker is not shown), and generally comprising:

A main body 10 of the heel cushion structure is made by integral plastic ejection, an inner side of the main body 10 is fixed to the lower edge of the rear of the sneaker. A space 11 is formed inside the main body 10, and the space 11 will be changed in height when it is subjected to a pressure. An upper threaded hole 12 and a lower threaded hole 13 are formed at an upper and a lower surface of the main body, respectively, in response to the space 11. The upper threaded hole 12 is smaller than the lower threaded hole 13, and a flange 14 is formed at the upper edge of the lower threaded hole 13.

A plurality of separable elastic elements 20 which produce elastic cushion effect in vertical direction, these separable elastic elements 20 are cone-shaped and installed in the space 11 of the main body 10 of the heel cushion structure. An upper annular portion 21 formed with threads 211 is provided on the top surface of elastic elements 20, and a lower annular portion 22 with threads 221 is provided at the bottom surface of the elastic elements 20. The elastic elements 20 are positioned in the main body 10 by screwing the upper and the lower annular portions 21, 22 in the upper and the lower threaded holes 12, 13, respectively. The upper annular portion 21 of the elastic elements 10 is provided with an annular flange 23 which serves to abut against the lower edge of the upper threaded hole 12 of the main body 10. The annular flange 23 is provided on the surface with plural anti-loosen threads, the lower annular portion 22 of the elastic elements 20 also serves to abut against the flange 14 of the lower threaded hole 13 of the main body 10.

The main body 10 of the heel cushion structure of the sneaker in this preferred embodiment is made by integral plastic ejection, a plastic spring 30 is additionally provided at the peripheral portion of the space 11 of the main body 10 (this is an optional design).

Since the upper threaded hole 12 is smaller than the lower threaded hole 13, the user can screw the elastic elements 20 easily into the space 11 from the upper annular portion 21, and fix the upper and the lower annular portions 21, 22 of the elastic elements 20 in the space between the upper and the lower threaded holes 12, 13 of the main body 10. Once the elastic elements 20 are fixed, the flange 14 of the lower threaded hole 13 will firmly abut against the flange 23 of the elastic elements 20. This structure enables the pressure on the main body 10 of the heel cushion structure to be well supported by the separable elastic elements 20, thus creating a perfect cushion effect.

It should be noted that the elastic elements 20 are separable and can be replaced and adjusted according to the wearer's real needs, thus, the wearer can select the sneaker with suitable heel cushion structure that well fits his/her weight. The separable elements 20 can be designed to have different functions, for example, to have different elastic forces, hardness, or it can produce voices, or the heel cushion structure can be interiorly provided with massaging device for massaging the underside of the foot (the above-mentioned functions all can be achieved by using the conventional elastic elements of the sneaker sold on the market). The present invention is truly a heel-cushion structure that can flexibly adjust the characteristics of the sneaker.

Figure 4:
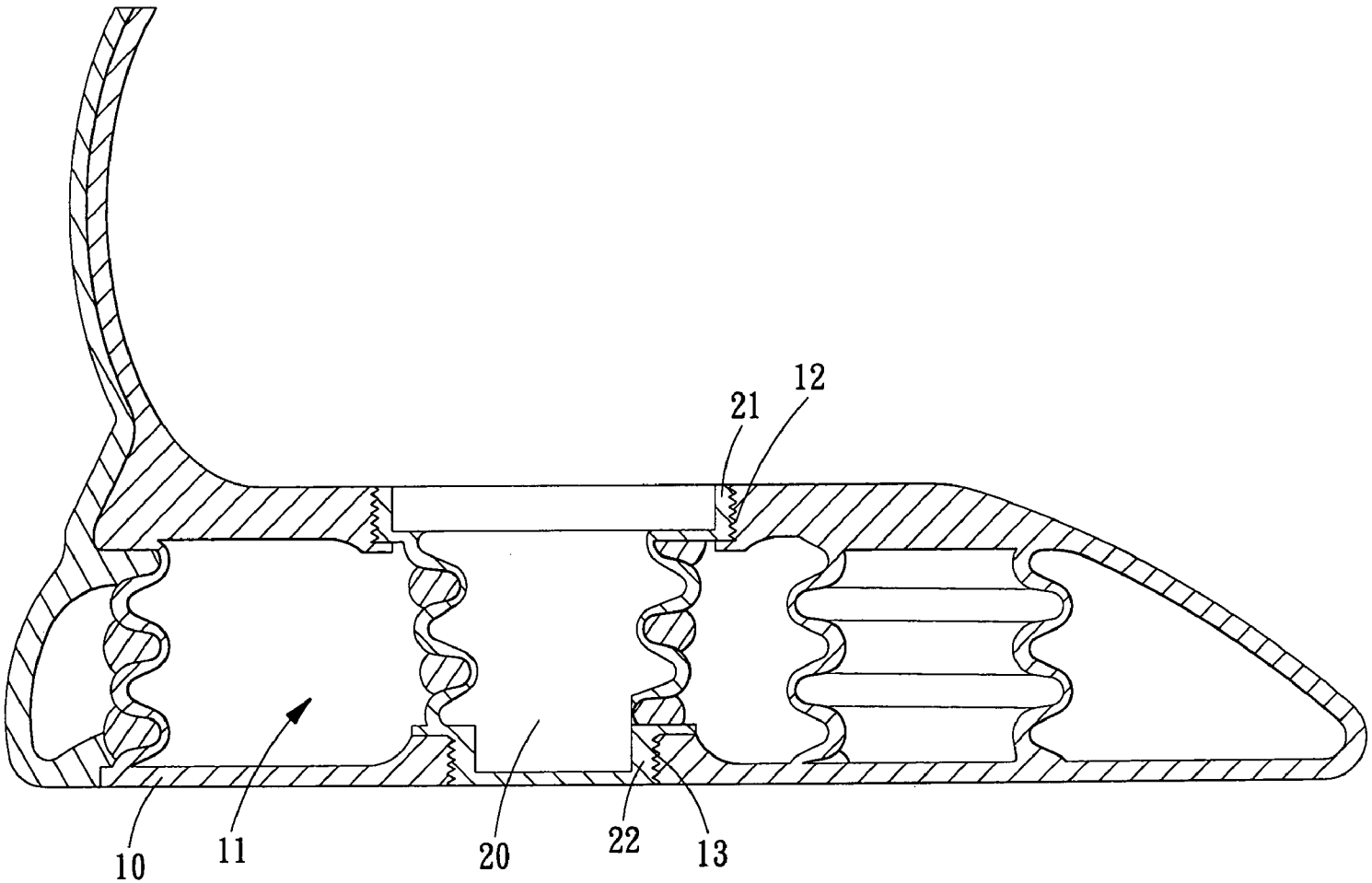
FIG. 4 is an assembly cross sectional view of a heel cushion structure for a sneaker in according with another preferred embodiment of the present invention.

On the other hand, as shown in FIG. 4, the upper threaded hole 12 in the space 11 in accordance another preferred embodiment of the present invention is bigger than the lower threaded hole 13. This structural design can enable the elastic elements 20 to be assembled in an opposite direction.

The elastic elements 20 in the above embodiments are the plastic spring as example, and the plastic spring can be formed easily with the upper and the lower annular portions 21, 22 by plastic ejection method, however, the separable elastic elements 20 still can be replaced in many other ways. For example, the elastic elements 20 can be interiorly provided with metal spring, air chamber, solid elastoplastic column, and etc. In addition, the number of the elastic elements 20 also can be varied with the changes of design. The elastic elements 20 in accordance with the present invention can enable the wearers to adjust the heel cushion effect by themselves after they buy the sneaker, thereby, the number of the elastic elements 20 will be omitted here.

While we have shown and described various embodiments in accordance with the present invention, it should be clear to those skilled in the art that further embodiments may be made without departing from the scope of the present invention.

What is claimed is:

1. A heel cushion structure for a sneaker installed at a lower edge of a rear of a sneaker, generally comprising:

a main body of the heel cushion structure made by plastic ejection, an inner side of the main body fixed to the lower edge of the rear of the sneaker, a space formed inside the main body, wherein the space will be changed in height when it is subjected to a pressure, an upper threaded hole and a lower threaded hole are formed at an upper and a lower surface of the main body, respectively, in response to the space;

a plurality of separable elastic elements, an threaded upper annular portion provided on a top surface of elastic elements, and a threaded lower annular portion provided at a bottom surface of the elastic elements, wherein the elastic elements are screwed and positioned in the main body between the upper and the lower threaded holes.

2. The heel cushion structure for a sneaker as claimed in claim 1, wherein the main body of the heel cushion structure is made by plastic ejection forming.

3. The heel cushion structure for a sneaker as claimed in claim 1, wherein a plastic spring is provided at a peripheral portion of the space of the main body.

4. The heel cushion structure for a sneaker as claimed in claim 1, wherein the upper threaded hole of the main body is smaller than the lower threaded hole, and the separable elastic elements are cone-shaped.

5. The heel cushion structure for a sneaker as claimed in claim 1, wherein the upper threaded hole of the main body is larger than the lower threaded hole, and the separable elastic elements are cone-shaped.

6. The heel cushion structure for a sneaker as claimed in claim 1, wherein the separable elastic elements are metal springs.

7. The heel cushion structure for a sneaker as claimed in claim 1, wherein the separable elastic elements are interiorly provided with air chamber.

8. The heel cushion structure for a sneaker as claimed in claim 1, wherein the separable elastic elements are solid elastoplastic columns.

9. The heel cushion structure for a sneaker as claimed in claim 1, wherein the number of the upper and the lower threaded holes, and the number of the separable elastic elements are determined according to design.

10. The heel cushion structure for a sneaker as claimed in claim 1, wherein the upper and the lower threaded holes of the main body are provided with a flange in response to an assembling direction of the separable elastic elements.

11. The heel cushion structure for a sneaker as claimed in claim 1, wherein the upper and the lower annular portions of the separable elastic elements are provided with an annular flange which serves to abut against the upper and the lower threaded holes of the main body.

12. The heel cushion structure for a sneaker as claimed in claim 1, wherein the annular flange of the separable elastic elements are is provided on its surface with a plurality of anti-loosen threads.

* * * * *